United States Patent [19]

Reinhardt

[11] Patent Number: 4,773,198

[45] Date of Patent: Sep. 27, 1988

[54] POST-TENSIONING ANCHORAGES FOR AGGRESSIVE ENVIRONMENTS

[75] Inventor: Peter Reinhardt, Roswell, Ga.

[73] Assignee: Continental Concrete Structures, Inc., Alpharetta, Ga.

[21] Appl. No.: 904,173

[22] Filed: Sep. 5, 1986

[51] Int. Cl.[4] ..... E04C 5/12

[52] U.S. Cl. ..... 52/223 L; 52/230

[58] Field of Search ..... 52/223 R, 223 L, 230; 264/228; 249/190, 217; 425/111; 24/122.6

[56] References Cited

U.S. PATENT DOCUMENTS

| | | | |
|---|---|---|---|
| 2,930,642 | 3/1960 | Howlett . | |
| 3,212,222 | 10/1965 | Wittfoht . | |
| 3,294,811 | 12/1966 | Rice . | |
| 3,343,808 | 9/1967 | Howlett . | |
| 3,449,876 | 7/1969 | Howlett . | |
| 3,520,032 | 7/1970 | Howlett et al. . | |
| 3,605,361 | 9/1971 | Howlett et al. . | |
| 3,646,748 | 3/1972 | Lang . | |
| 3,766,609 | 10/1973 | Brandestini et al. | 24/115 M |
| 3,833,706 | 9/1974 | Edwards | 52/230 |
| 3,935,685 | 2/1976 | Howlett . | |
| 3,956,797 | 5/1976 | Brandestini et al. | 52/230 |
| 3,967,421 | 7/1976 | Dufossez . | |
| 4,235,055 | 11/1980 | Schambeck . | |
| 4,348,844 | 9/1982 | Schupack et al. | 52/230 |
| 4,363,462 | 12/1982 | Wlodkowski et al. | 52/223 L |
| 4,368,607 | 1/1983 | Boonman | 52/223 R |

*Primary Examiner*—James L. Ridgill, Jr.
*Attorney, Agent, or Firm*—Kilpatrick & Cody

[57] ABSTRACT

Tendon anchorages for aggressive environments. Tendon anchors according to the present invention include forward and rear connection means for fluid-resistant connection to adjacent members to protect the tendon strand from corrosive elements. A fixed anchorage according to the present invention includes a connector connected to the anchor plate rear connection means and the strand sheath in a fluid-resistant relationship and a cap threaded onto the anchor plate forward connection means to form a fluid-resistant connection after the strand has been tensioned. An intermediate anchorage according to the present invention replaces the cap with an adaptor which is threaded onto the anchor plate front connection means. The adaptor not only secures the anchor plate to the structure formed druing pouring of the structure, but also forms a fluid-resistant connection with a second connector which in turn forms a fluid-resistant connection with the strand sheath. The invention further includes a mount for securing an anchor plate to a structure form for forming a fixed anchorage. The mount includes a spindle with a nose piece which cooperates with the wedge-gripper cavity of the anchor plate to prevent the wedge-gripper cavity from becoming occluded with concrete or other foreign material during pouring of the structure.

12 Claims, 7 Drawing Sheets

POST-TENSIONING ANCHORAGES FOR AGGRESSIVE ENVIRONMENTS

BACKGROUND OF THE INVENTION

Post-tensioning techniques are now commonly used in construction of buildings, bridges, nuclear containment structures, water storage tanks, foundations, dams and other concrete structures. Such techniques are generally recognized as having originated when Eugene Freyssinet began using high strength steel wires for post-tensioning or prestressing concrete beams as early as 1928. By 1939 a system of using wedges for anchoring the wires and jacks for use in stressing was prevalent. Advantages from these techniques today accrue in the form of reduced structural depth, water-tight slabs with minimal cracks, control of deflection, longer spans at more economical cost and the ability to cast concrete in place rather than being required to assemble prestressed sections.

Post-tensioning of concrete structures is typically accomplished with tendons. Tendons are formed of prestressing steel, which may be wire, high strength bar or steel strands. Steel strands may be enclosed in sheathing to provide corrosion protection and eliminate bonding between the pre-stressing steel and the surrounding concrete. Tendons in which the pre-stressing steel is permanently free to move relative to the concrete are known as unbonded tendons.

Strands may be anchored with anchor devices which restrain a group of strands or which restrain only one strand. The former are known as multistrand anchors while the latter are known as monostrand anchors.

This invention relates primarily, but is not limited to, monostrand anchorages for unbonded tendons.

An anchor for monostrand tendons typically includes a passage through which the strand passes. The passage usually includes a generally frusto-conical shaped portion. Strands are inserted in passages of appropriate anchors which have been mounted to the structure forms. After concrete has been poured and allowed to set, wedges are interposed against the strands in the frusto-conical cavities and tension is applied to the strands by external means. The wedges restrain the strands from contracting once they have been tensioned. Such an arrangement is shown, for instance, in U.S. Pat. No. 3,956,797 to Brandestini, et al., which is incorporated by reference. A pocket former is typically placed between the anchor and the structural form before pouring to leave a pocket between the anchor and the finished concrete exterior for accessing a strand. After tensioning the pocket is typically filled and finished with grouting material.

Such techniques have proved effective in the many varieties of structures mentioned above. Such an arrangement which leaves the tendon anchorage and end exposed to concrete may prove inadequate in corrosive or aggressive environments, however. Such environments include, for example, parking structures and exposed buildings in coastal areas or post-tensioned pavements which are frequently salted. Other susceptible structures may be underground structures in the vicinity of salted roads, such as building foundations and parking lots.

Although concrete typically protects the prestressing steel in such structures, chloride ions in water or other corrosive elements sometimes reach the steel. Corrosion occurs in the presence of oxygen in such cases. The corrosion of steel forms products which occupy a volume approximately ten times greater than that of the steel which has been corroded. The expansive forces created by this increased volume cause cracking and spalling. This process leads to further exposure of the prestressing steel to corrosive elements and accelerated likelihood of structural failure.

One approach to reducing such corrosion has been to encapsulate the anchorage, including the entire anchor, in an envelope formed of electrially insulating material. U.S. Pat. No. 4,348,844 issued Sept. 14, 1982 to Schupack. et al., for example, which is incorporated by reference, shows such an arrangement. This structure is expensive, however, and fails to take advantage of the fact that sufficient corrosion protection of the anchor casting is normally provided by the alkalinity of the bonded concrete encasement. Such castings in any event have been shown to be much less sensitive than the strand to corrosion. Thus, economy would be achieved in a tendon anchorage which does not require a separate manufacturing step for surrounding the precast anchorage in an envelope, but which allows the anchor instead to be connected in a fluid-tight or fluid-resistant relationship with its adjoining elements in the tendon.

SUMMARY OF THE INVENTION

Tendon anchors according to the present invention include an anchor plate which has a front connection lip and a rear connection protrusion. These are used to seal the anchor plate in a fluid-resistant relationship with adjacent protective members in order to protect the surrounded strand from corrosive elements in the tendon's environment.

The anchor plate front lip may be threaded to accept a spindle for mounting the plate to a form during pouring of the concrete structure. The spindle of the present invention is conveniently constructed to eliminate the need for use of nails or other means to attach the plate to the form. A pocket former may be inserted between the plate and the form on the spindle. The spindle, pocket former and plate are held in place by a follower which grips and secures the spindle against the form. The spindle preferably includes a nose which conforms to the shape of the wedge-gripper cavity of the anchor plate to prevent or reduce the possibility of occlusion of that cavity with concrete or other foreign matter during pouring of the structure.

After the structure is poured and the form is removed, the pocket former may be slid off the spindle and the spindle unscrewed from the anchor plate. Wedges then may be inserted into the anchor plate and the strand tensioned. A cap may then be screwed onto the front lip of the anchor plate to form a fluid-resistant connection before the pocket is grouted.

Where the anchor plate is used as an intermediate anchor for a single monostrand tendon, use of a pocket form may not be desired. In that case, an adaptor may be threaded onto the front lip of the anchor plate. A forward protrusion of the adaptor is then placed in a hole in the form for pouring. Wedges may, but need not be, inserted in the anchor plate before the adaptor is connected to it.

It is therefore an object of the present invention to provide a tendon anchor for use in aggressive environments which may be efficiently manufactured and installed, and which may be provided at reasonable cost.

It is an additional object of the present invention to provide a tendon anchor which includes a front and rear connection means for connection to other members in order to allow the anchor plate to cooperate with those members to form a fluid-resistant seal in order to protect the tendon strand from corrosive elements.

It is an additional object of the present invention to provide a tendon anchorage which may be easily and readily secured to the form of the structure to be poured.

It is a further object of the present invention to provide a tendon anchor which may be conveniently prepared for tensioning after pouring of the concrete structure and conveniently capped and sealed after tensioning.

It is a further object of the present invention to provide a tendon anchor plate which is adapted to serve as a fixed anchorage or an intermediate anchorage in aggressive environments by forming fluid-resistant connections with members adjacent to it which surround the tendon strand.

Other objects, features and advantages of the present invention will become apparent by reference to the remainder of the specification and drawings.

DETAILED DESCRIPTION OF THE DRAWINGS

Figure 1:
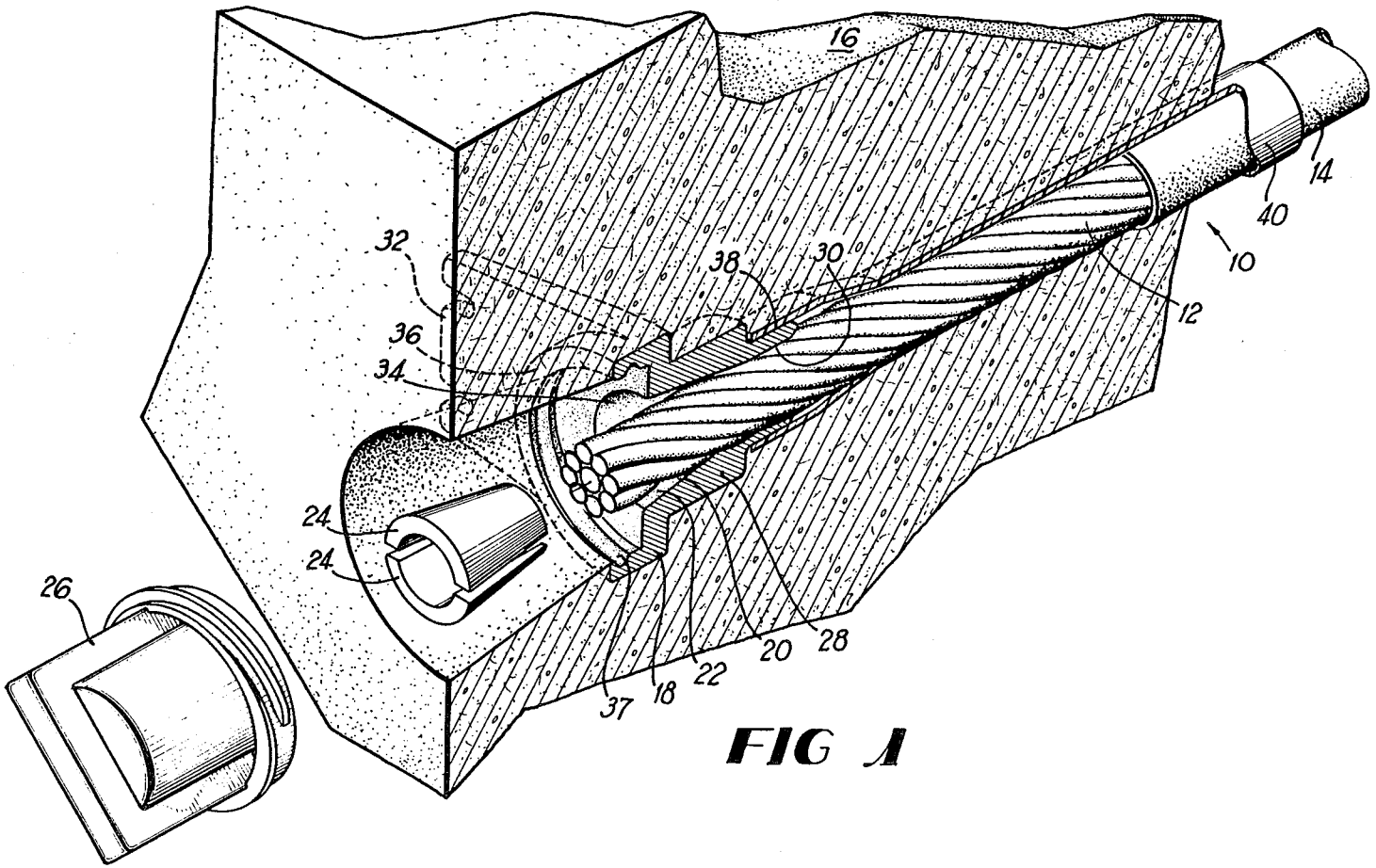
FIG. 1 is a perspective cross-sectional partially exploded view of a fixed anhorage according to the present invention.

FIG. 1 illustrates a fixed anchorage 10 according to the present invention. A tendon strand 12 is surrounded by a sheath 14 and is placed before pouring of structure 16 in a conventional manner. An anchor plate 18 contains a strand passage 20 through which strand 12 passes.

Strand passage 20 includes a wedge-gripper cavity 22 which is substantially frusto-conical in shape. Wedges 24 are shaped and employed in a conventional manner. After strand 12 has been tensioned, cap 26 is connected to anchor plate 18 to form a fluid-resistant connection.

Figure 4:
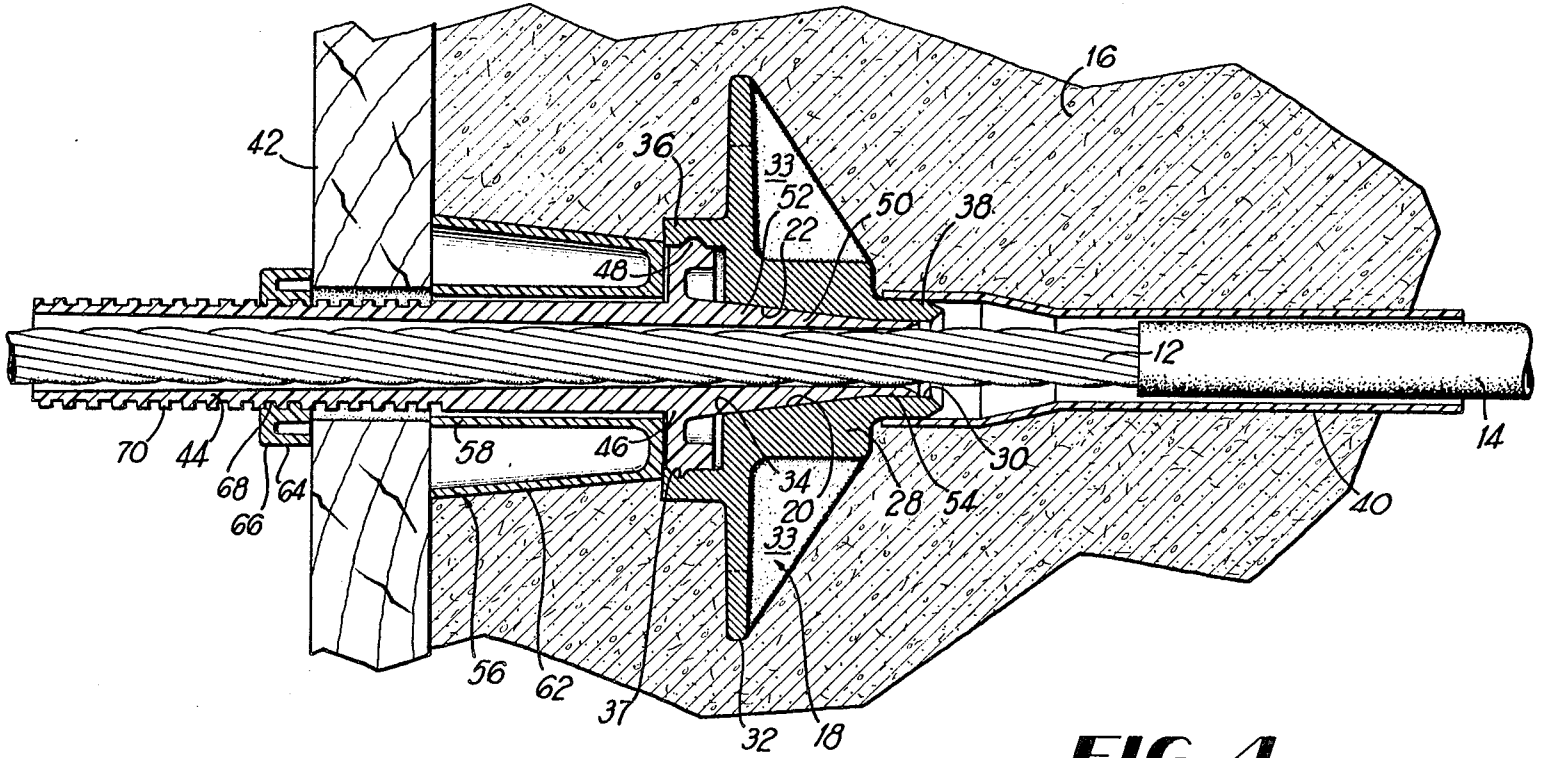
FIG. 4 is a cross-sectional view of a stressing anchorage corresponding to the anchorage in FIG. 3.

Anchor plate 18 of the present invention is designed and constructed to allow it to be connected in a fluid-resistant relationship with other members to protect strand 12 from corrosive elements to which it may otherwise be exposed. With reference to FIGS. 1 and 4, anchor plate 18 is formed of a generally cylindrical body 28. Body 28 includes strand passage 20, which in turn includes wedge-gripper cavity 22. Strand passage 20 may also include a rear cavity 30 adjacent to the smaller end of wedge-gripper cavity 22. In the preferred embodiment, rear cavity 30 is generally cylindrical in shape. It may, however, be frusto-conical or of other appropriate shape having an expanding or nonuniform cross-section. In the embodiment shown in FIGS. 1 and 4, the end of strand passage 20 toward the smaller end of wedge-gripper cavity 22 is chamfered to allow easier introduction of strand 12 into passage 20 during set up.

Extending from anchor plate 28 generally radially from or perpendicular to the axis of body 28 and its strand passage 20 is a web or bearing plate 32 for stabilizing the anchor plate in the surrounding concrete structure. Bearing plate may be supported by ridges 33 spanning it and body 28 to add rigidity to anchor plate 18 and to limit flexure of bearing plate 32 as anchor plate 18 is loaded by strand 12. Ridges 33 preferably are oriented toward the rear of plate 18 so that they are under tension while plate 18 is loaded by strand 12.

Bearing plate 32 of anchor plate 18 is placed at or toward the large or forward end 34 of strand passage 20. Such placement allows bearing plate 32 not only to stabilize anchor plate 18 in the surrounding structure, but also to perform the important secondary function of increasing the moment of inertia of anchor plate 18 in the vicinity of surfaces of wedge-gripper cavity 22 upon which wedges 24 will be acting when loaded by strand 12. Thus, hoop or ring forces placed on the surfaces of wedge-gripper cavity 22 and anchor plate body 28 are absorbed not only by body 28 but also by bearing plate 32. This structure reduces deformation of anchor plate 18 when loaded by strand 12 and wedges 24 and thus prevents or reduces tendon strand 12 creep with respect with to anchor plate 18. It also allows anchor plate 18 to be constructed lighter in weight and of less material and therefore at reduced expense.

The forward portion of anchor plate body 28 forms a connection means or lip 36 which may be used to connect anchor plate 18 to other members in a fluid-resistant relationship. This is preferably accomplished by threading the interior surface of forward connection means 36 with threads 37 as shown in FIGS. 1 and 4. However, it may also be accomplished by placing snap rings, bayonet fittings or other desires fittings on forward connection means 36 for securing it to adjacent members.

The rear portion of anchor plate body 28, or the portion in the direction of the smaller end of wedge-gripper cavity 22, forms a rear connection means or protrusion 38 for connecting anchor plate 18 to adjacent members in a fluid-resistant relationship. Rear connection means 38 in the illustrated embodiment forms a generally cylindrical surface to which adjacent members can be secured. It may also be threaded, fitted with snap rings, bayonet fittings or other fittings as desires. In the embodiment illustrated in FIGS. 1 and 4, rear connection means 38 forms a fluid-resistant connection with a connector 40. Connector 40 in the illustrated embodiments is a length of tubing of appropriate PVC or other polymeric or appropriate material. Rear connection means 38 may also be connected to sheath 14 by tape or other appropriate means rather than utilizing connector 40.

Anchor plate 18 may be sand cast or manufactured according to any other desired method. Although casting of threads such as those in forward connection means 36 is typically expensive, it has been found that anchor plates 18 of the present invention may be sand cast in vertical position rather than horizontal so that a larger number of castings may be produced in a single mold. Accordingly, the design features of anchor plate 18 which allow it to be compact and thus allow vertical casting offset costs resulting from casting threads 37.

Figure 2:
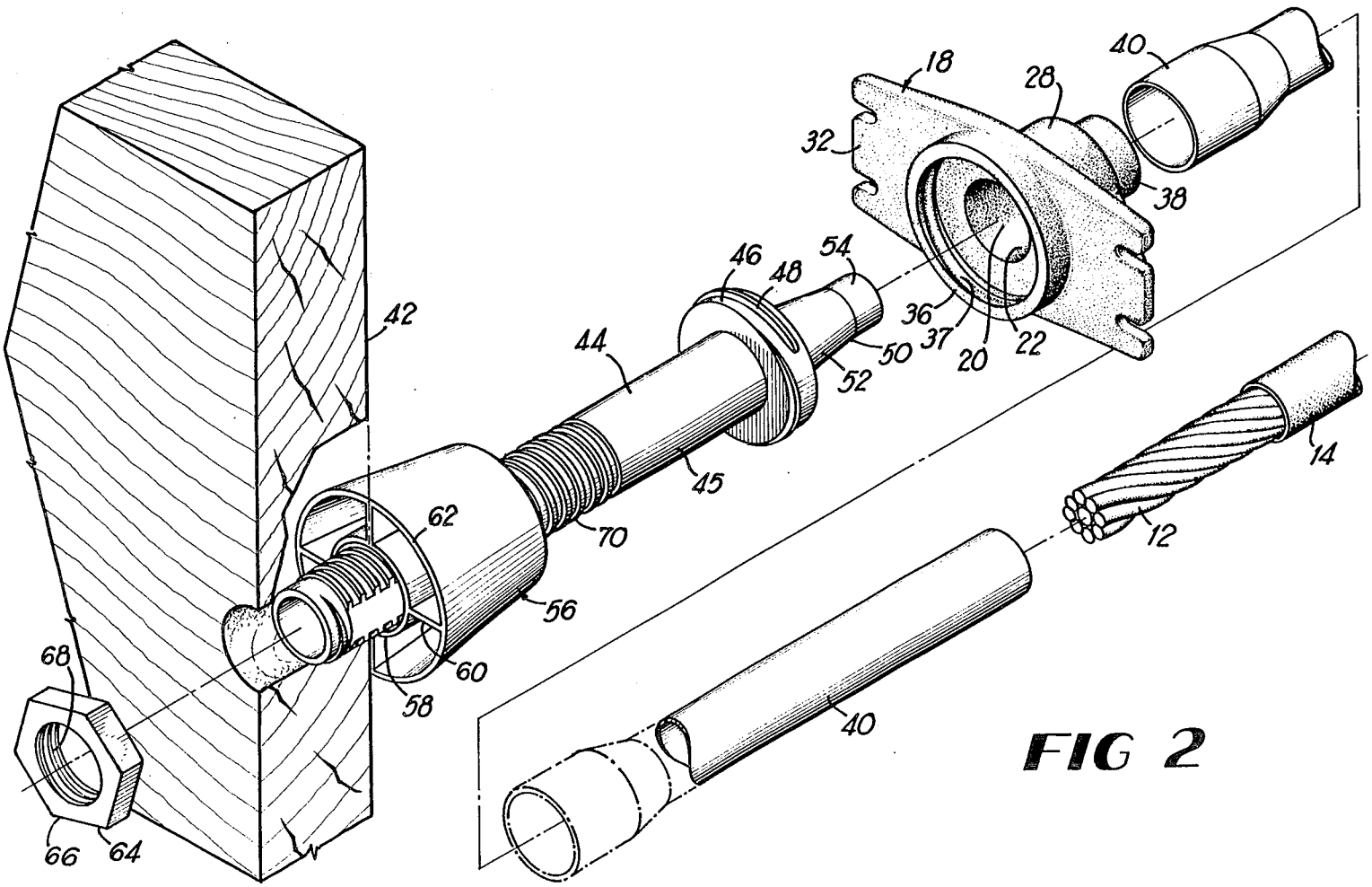
FIG. 2 is a perspective partially exploded view of a stressing anchorage according to the present invention.
Figure 3:
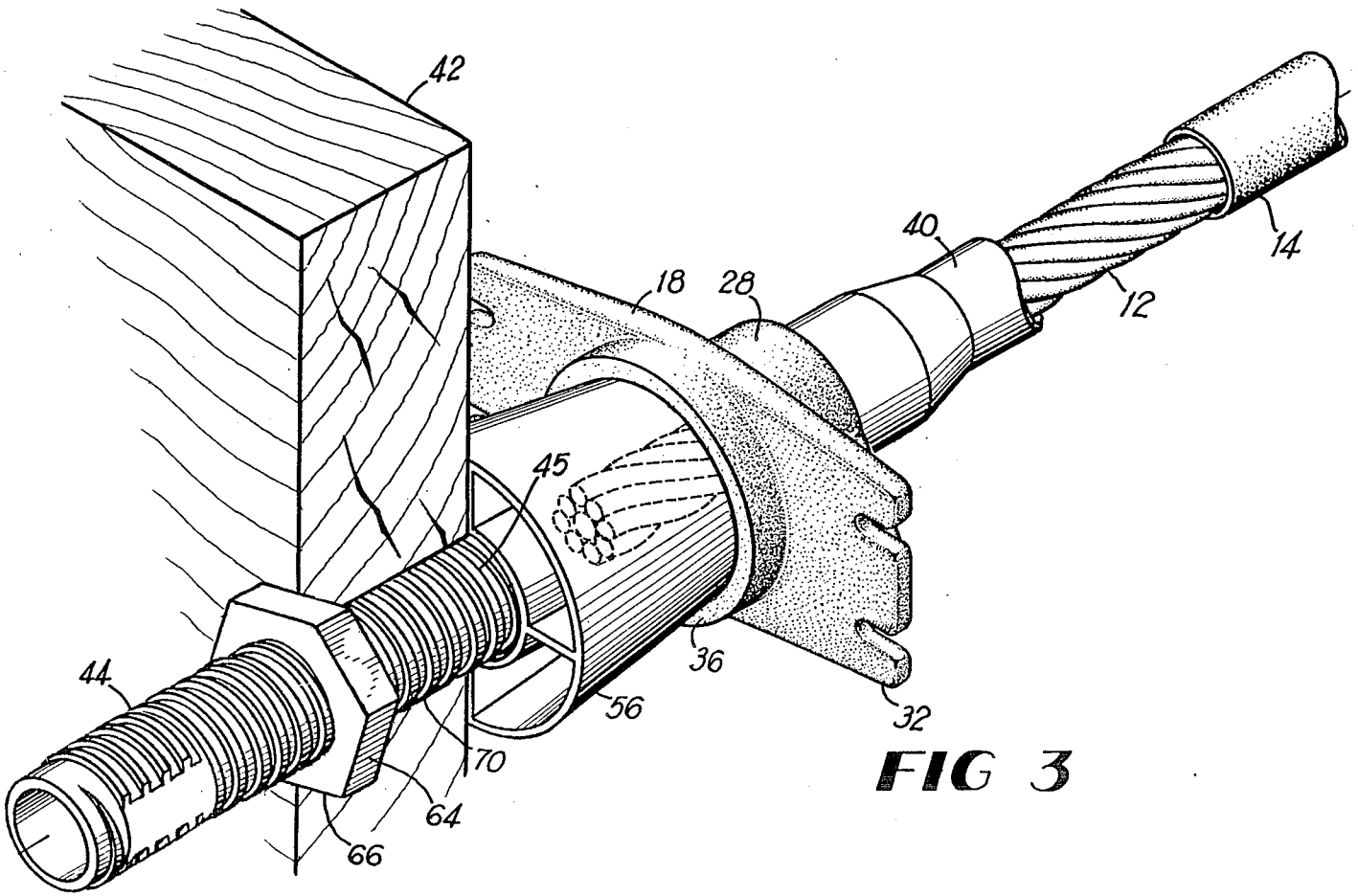
FIG. 3 is a perspective partial cross-sectional view of a stressing anchorage according to the present invention showing a mount according to the present invention for securing the anchorage to the structure form.

FIGS. 2 and 3 illustrate a preferred method and means for mounting anchor plate 18 to a form 42 to prepare an anchorage in a concrete structure. A spindle 44 is connected to anchor plate 18 and secures it in place on form 42. Spindle 32 in the illustrated embodiment is generally in the form of a shank 45 which forms a flange 46 at one end. Flange 46 in turn forms threads, snap fittings or other appropriate fittings to cooperate with forward connection means 36 of anchor plate 18. In the preferred embodiment, flange 46 forms a thread 48 for cooperating with the corresponding thread 37 on forward connection means 36 of anchor plate 18. Spindle 44 is simply and conveniently screwed onto anchor plate 18 in this embodiment.

Forward of the flange 46 and extending from spindle 44 is a nose which corresponds in shape to strand passage 20 of anchor plate 18. In the illustrated embodiment, nose 50 comprises a frusto-conical portion 52 extending from spindle 44, and a generally cylindrical portion 54 extending from frusto-conical portion 52. Cylindrical portion 54 is not needed where strand passage 20 of anchor plate 18 includes only a wedge-gripper cavity 22 and no rear cavity 30. In any event, nose 50 fits generally with the surfaces of strand passage 20 to prevent or reduce the possibility of strand passage 20 being occluded by concrete or other foreign material while the structure 16 is being poured.

A pocket former 56 is preferably placed on spindle 44 before spindle 44 is secured to form 42. Pocket former 56 serves the conventional purpose of allowing anchor plate 18 and strand 12 to be accessed after structure 16 has set and form 42 is removed, for tensioning and grouting. Pocket former 56 may be more easily removed to access plate 18 because pocket former 56 is slidably received by spindle 44 rather than forming a portion of spindle 44. This arrangement alleviates the necessity of being required to torque spindle 44 a sufficient amount to overcome frictional forces between pocket former 56 and concrete structure 16 as well as between flange 46 and forward connection means 36 of anchor plate 18. Instead, pocket former 56 may first be removed and then spindle 44 may be removed.

Pocket former 56 is preferably frusto-conical in shape and is formed of PVC or other suitable polymeric or other type material as are other components of the anchorage, including cap 26, spindle 44, follower 64 and connectors 40 and 82. In the preferred embodiment, pocket former 56 includes an inner ring 58 for slidably receiving spindle 44. Inner ring 58 is connected by radial vanes 60 to outer ring 62 forming the outer, and preferably frusto-conical, surface. Vanes 60 are useful not only from a structural point of view, but also to assist in removal of pocket former 56 from structure 16.

Spindle 44 may be secured to form 42 by an appropriate follower 64. Follower 64 may be a clamp or other device to grip spindle 44. In the preferred embodiment, follower 64 is a nut 66 having a threaded portion 68 for cooperating with threads 70 which may be included on the surface of spindle 44.

FIG. 4 is a cross-sectional view of anchor plate 18 secured to form 42 by spindle 44 and pocket form 56. Nose 50 is in place in wedge-gripper cavity 22 to prevent foreign material from occluding that cavity. Spindle 44 secures anchor plate 18 against pocket former 56 and thus against form 42. Connector 40 seals rear connection means 38 of anchor plate 18 to sheath 14 of strand 12 to protect strand 12 from corrosive elements.

Figure 5:
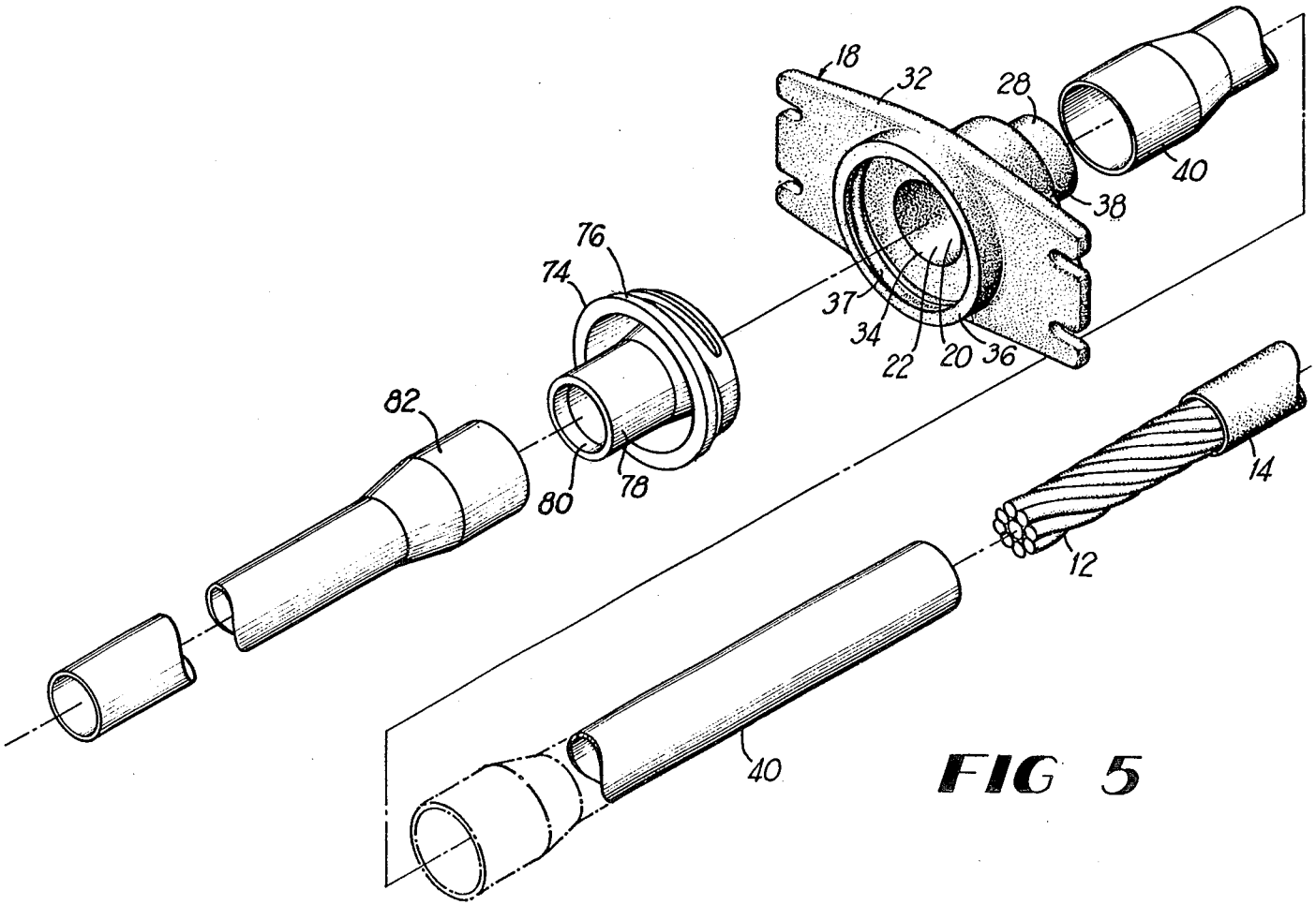
FIG. 5 is a perspective exploded view of an intermediate anchorage an according to the present invention.
Figure 6:
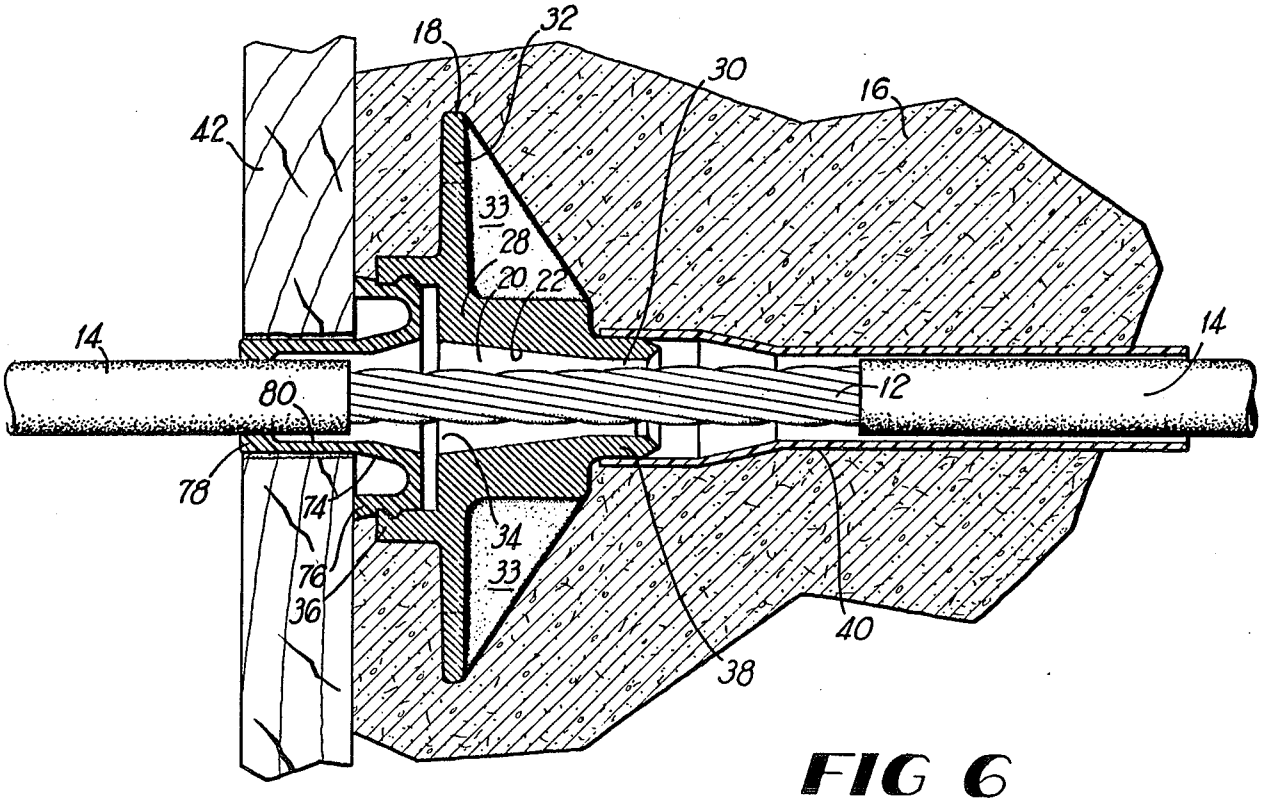
FIG. 6 is a cross-sectional view of an intermediate anchorage of the present invention attached to a form.
Figure 7:
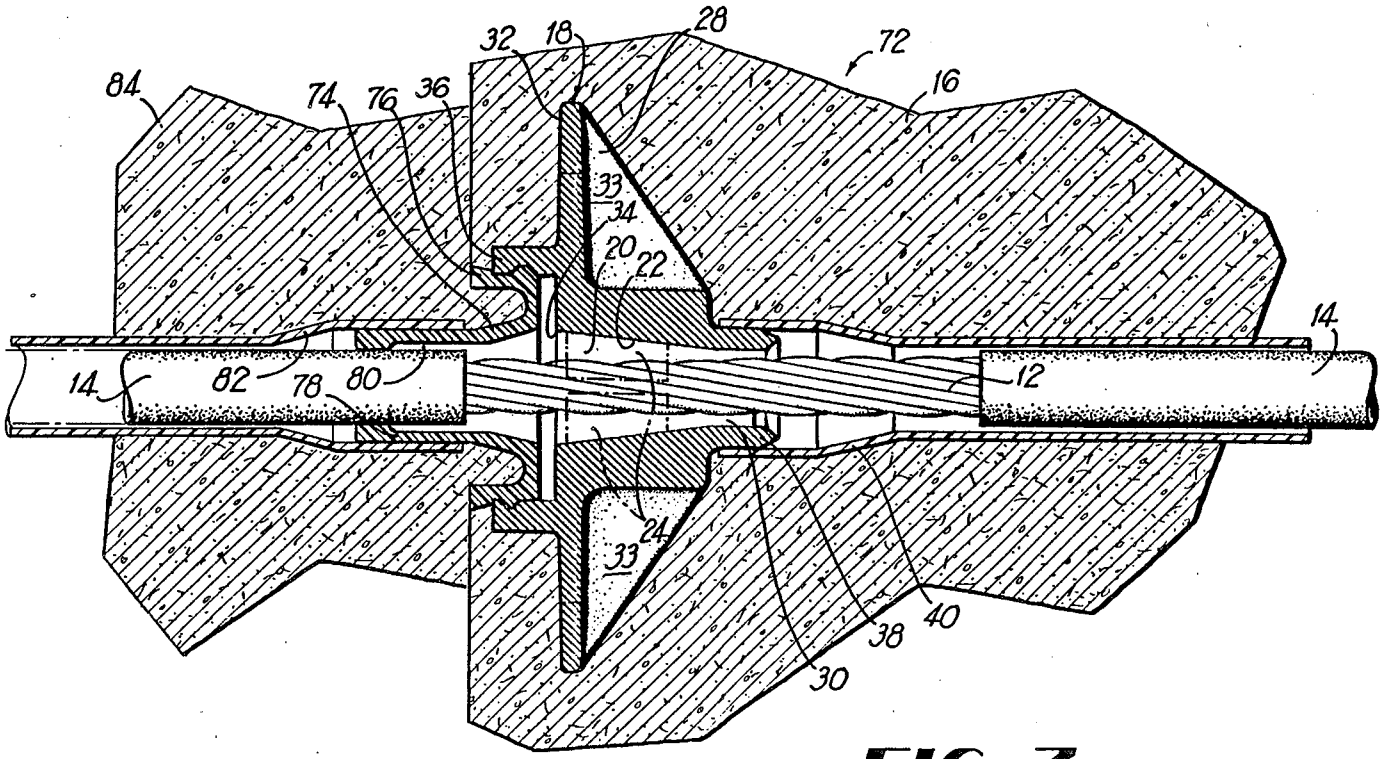
FIG. 7 is a cross-sectional view of the anchorage of FIG. 6 in place forming fluid-resistant protection for the tendon strand.

Anchor plate 18 may also be conveniently utilized to form an intermediate anchorage 72 rather than a fixed anchorage 10, as shown in FIGS. 5–7. An adaptor 74 may in such cases be connected to forward connection means 36 of anchor plate 18. Adaptor 74 includes a flange 76 which may form threads, snap rings or other fittings for cooperating with the fittings on forward connection means 36. Flange 76 is attached to a preferably generally cylindrical forward protrusion 78 which defines a strand passage 80. Adaptor 74 may also be constructed of PVC or other appropriate polymeric or other material.

As shown in FIG. 5, adaptor 74 is connected to anchor plate 18 and its forward protrusion 78 is inserted in a hole in form 42. After structure 16 is poured and allowed to set, form 42 is removed and a new second connector 82 may be connected to forward protrusion 78 of adaptor 74 to form a fluid-resistant connection. The second adjacent concrete structure 84 is poured and strand 12 is protected by the intermediate anchorage comprising connector 40, anchor plate 18, adaptor 74 and second connector 82.

This description is provided for illustration and description of preferred embodiments of the invention. Modifications and adaptations to these embodiments will be apparent to those of ordinary skill in the art and may be made without departing from the scope or spirit of the invention.

I claim:

1. An anchorage for a sheathed tendon, comprising:

(a) an anchor plate through which a tendon strand may pass, comprising:

(i) a generally cylindrically shaped body with a front end and rear end which body forms a wedge-gripper cavity that opens in the front end and a strand passage that opens in the rear end and communicates with the wedge-gripper cavity;

(ii) a bearing plate which extends radially from the body adjacent to the front end;

(iii) a front annular connection lip which extends from the front end of the body, which is oriented coaxially with the wedge-gripper cavity and the strand passage, and which contains a thread on its inner annular surface to receive another threaded member in a sealing relationship; and (iv) a rear cylindrically shaped connection lip which extends from the rear end of th body and which forms an interior and an exterior cylindrically shaped surface, the interior surface forming part of the strand passage and the exterior surface for receiving in a sealing relationship a connector which surrounds the tendon strand and protects it from moisture;

(b) a cap having a threaded portion connected to the front connection lip of the anchor plate in a sealing relationship; and (c) a tubular shaped connector having a flared front end connected to the exterior surface of the rear connection lip of the anchor plate in a sealing relationship and a rear end connected to the tendon sheathing in a sealing relationship.

2. An anchorage according to claim 1 in which the wedge-gripper cavity is substantially frusto-conical in shape.

3. An anchorage according to claim 2 which further comprises a plurality of wedges shaped to accommodate the wedge-gripper cavity and the tendon strand in the cavity and to restrain the tendon strand from being withdrawn from the smaller end of the wedge-gripper cavity.

4. An anchorage mount for mounting an anchor plate having a wedge-gripper cavity and a front connection means to a form, comprising:

(a) a spindle, comprising:
  (i) a threaded shank;
  (ii) a flange connected coaxially to the shank, which flange cooperates with the anchor plate front connection means to grip the anchor plate to form a seal to prevent cement from entering the wedge-gripper cavity of the anchor plate; and
  (iii) a nose formed coaxially on the shank which forms a surface for cooperating with the anchor plate wedge-gripper cavity to prevent that passage from becoming occluded;
(b) a pocket form removably mounted on the shank for forming a pocket in the structure to be post-tensioned so that the anchor plate and the tendon strand may be accessed after the structure is in place; and
(c) a follower for receiving the threaded portion of the spindle shank and securing the shank, pocket form and anchor plate to the form.

5. An anchor mount according to claim 4 in which the spindle shank further comprises a non-threaded portion for slidably receiving the pocket form.

6. An anchorage mount according to claim 4 in which the flange comprises a threaded portion for cooperating with the threaded portion of the anchor plate front connection means to grip the anchor plate.

7. An anchor mount according to claim 4 in which the nose comprises a frusto-conically shaped portion connected to a generally cylindrically shaped portion to cooperate with corresponding shaped portions of the tendon strand passage in the anchor plate.

8. An anchor mount according to claim 4 in which the pocket form is frusto-conically shaped and contains a passage for slidably receiving the spindle shank.

9. An anchorage mount according to claim 4 in which the follower is a nut.

10. An intermediate anchorage for a sheathed tendon, comprising:

(a) an anchor plate through which a tendon strand may pass, comprising:
  (i) a generally cylindrically shaped body with a front end and rear end which body forms a wedge-gripper cavity that opens in the front end and a strand passage that opens in the rear end and communicates with the wedge-gripper cavity;
  (ii) a bearing plate which extends radially from the body adjacent to the front end;
  (iii) a front annular connection lip which extends from the front end of the body, which is oriented coaxially with the wedge-gripper cavity and the strand passage, and which contains a thread on its inner annular surface to receive another threaded member in a sealing relationship; and
  (iv) a rear cylindrically shaped connection lip which extends from the rear end of the body and which forms an interior and an exterior cylindrically shaped surface, the interior surface forming part of the strand passage and the exterior surface for receiving in a sealing relationship a connector which surrounds the tendon strand and protects it from moisture;
(b) a tubular shaped first connector having a flared front end connected to the rear connection lip of the anchor plate in a sealing relationship and a rear end connected to the tendon sheathing in a sealing relationship;
(c) an adaptor, comprising:
  (i) a generally cylindrically shaped body with a front end and a rear end which body forms a strand passage between the front and rear ends;
  (ii) a connector flange which extends radially form the rear end and which includes a threaded portion connected to the front connection lip of the anchor plate in a sealing relationship;
  (iii) a front generally cylindrically shaped connector lip formed by the body having an interior surface which forms part of the strand passage and an exterior surface for receiving in a sealing relationship a connector which surrounds the tendon strand and protects it from moisture; and
(d) a tubular shaped second connector having a flared rear end connected to the front connector lip of the adaptor in a sealing relationship and a front end connected to the tendon sheathing in a sealing relationship.

11. An anchorage according to claim 10 in which the wedge-gripper cavity is substantially frusto-conical in shape.

12. An anchorage according to claim 11 which further comprises a plurality of wedges shaped to accommodate the wedge-gripper cavity and the tendon strand in the cavity and to restrain the tendon strand from being withdrawn from the smaller end of the wedge-gripper cavity.

* * * * *